US008668594B1

(12) United States Patent
Girifalco

(10) Patent No.: US 8,668,594 B1
(45) Date of Patent: Mar. 11, 2014

(54) APPARATUS FOR PRACTICING A GOLF SWING

(71) Applicant: John Joseph Girifalco, Wilmington, DE (US)

(72) Inventor: John Joseph Girifalco, Wilmington, DE (US)

( * ) Notice: Subject to any disclaimer, the term of this patent is extended or adjusted under 35 U.S.C. 154(b) by 0 days.

(21) Appl. No.: 13/660,993

(22) Filed: Oct. 25, 2012

(51) Int. Cl.
*A63B 69/36* (2006.01)

(52) U.S. Cl.
USPC ..... 473/147; 473/149

(58) Field of Classification Search
USPC ..... 473/139, 142, 143, 147, 149, 423, 575
See application file for complete search history.

(56) References Cited

U.S. PATENT DOCUMENTS

| | | | | | |
|---|---|---|---|---|---|
| 3,502,337 | A | * | 3/1970 | Butkus | 473/147 |
| 3,521,887 | A | * | 7/1970 | Butkus | 473/147 |
| 4,660,835 | A | * | 4/1987 | Locurto | 473/147 |
| 4,927,154 | A | * | 5/1990 | Boyer et al. | 473/142 |
| 5,054,786 | A | * | 10/1991 | Solomon | 473/147 |
| 5,599,238 | A | * | 2/1997 | Roderick | 473/147 |

* cited by examiner

*Primary Examiner* — Nini Legesse

(57) ABSTRACT

A device allows a golfer to hit full swing golf shots with a real ball in a limited area while still providing the golfer with trajectory information about their shot and realistic feel of an actual golf ball. The device tethers a golf ball to the ground. When the golfer swings, the ball flies about 20 yards and drops to the ground. The device is easy to use and affordable. The device is made from two different cord materials, one being more elastic than the other, allowing the golfer to hit a ball without having the ball spring back to hit the golfer. The golf ball can be attached to the cord with a lightweight screw eye screwed into the ball.

10 Claims, 2 Drawing Sheets

APPARATUS FOR PRACTICING A GOLF SWING

BACKGROUND OF THE INVENTION

The present invention relates to golfing accessories and, more particularly, to an apparatus that allows a golfer to hit full swing golf shots with a real ball in a limited area, such as a 20-yard area.

It is difficult to hit a golf ball in a confined area. The distance that a real golf ball travels makes it impossible to practice a full swing golf shot at home.

Currently, golf nets are often used to practice golf swings in limited spaces. However, using nets provide no ball flight trajectory information to the golfer and therefore no visual feedback.

Plastic or faux golf balls can currently be used in a limited area by golfers, to practice their swing. These plastic/faux balls, however, are lightweight and provide an unrealistic feel.

Virtual golf courses are also available for golfers. While these can provide ball flight on a projector screen, these systems cost thousands of dollars and are not very useful for a golfer to practice their swing at home.

As can be seen, there is a need for a device that allows a golfer to practice their full swing golf shots in a limited space while still providing trajectory information and realistic feel to the golfer.

SUMMARY OF THE INVENTION

In one aspect of the present invention, a golf swing practice device comprises a more elastic bungee cord on the end attached to a golf ball; a less elastic nylon cord is attached to a second, opposite end of the elastic cord; and a securement attached to the less elastic cord.

In another aspect of the present invention, a golf swing practice device comprises a bungee cord having a first end attached to a golf ball; a parachute cord attached to a second, opposite end of the bungee cord; a weight attached to the parachute cord; and an eyebolt attached to the golf ball, the more elastic cord disposed through the eyebolt.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device that allows a golfer to hit full swing golf shots with a real ball in a limited area while still providing the golfer with trajectory information about their shot. The device tethers a golf ball to the ground. When the golfer swings, the ball flies about 20 yards and drops to the ground. The device is easy to use and affordable. The device is made from two different cord materials, one being more elastic than the other, allowing the golfer to hit a ball without having the ball spring back to hit the golfer. The golf ball can be attached to the cord with a lightweight screw eye screwed into the ball.

Figure 1:
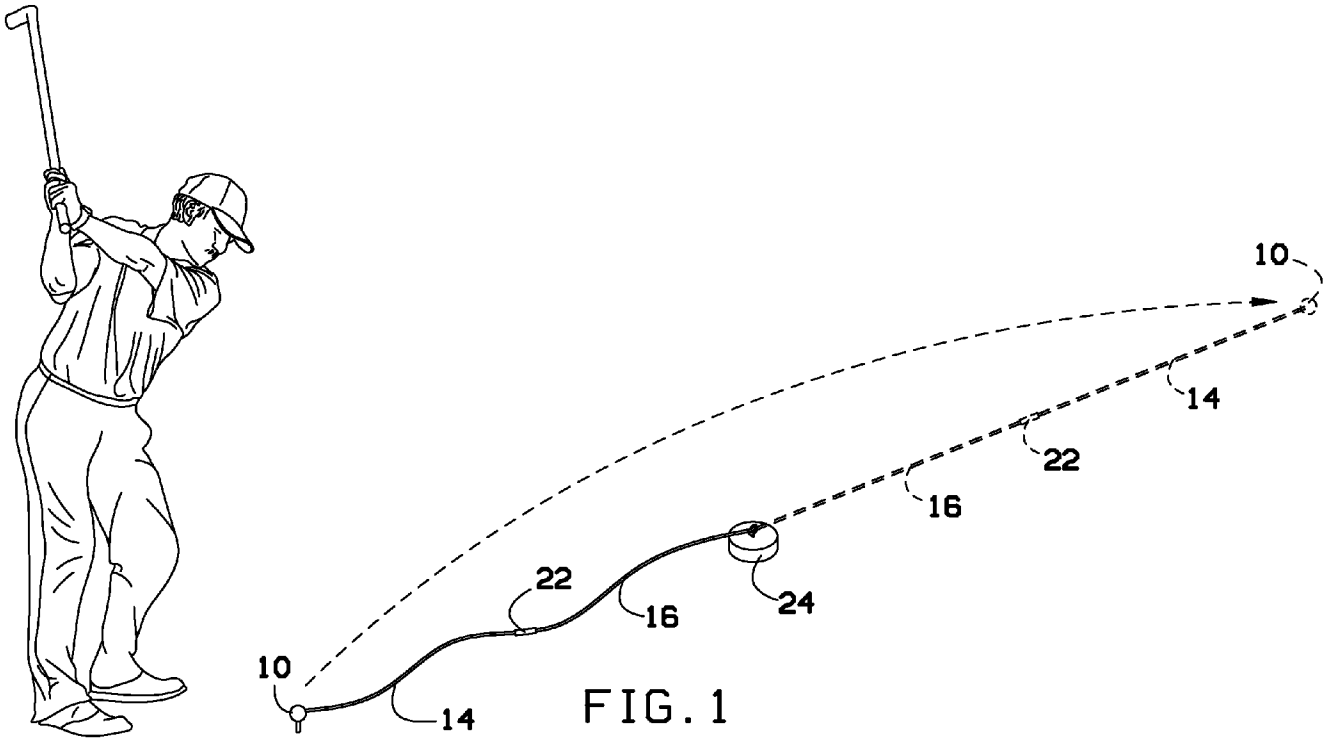
FIG. 1 is a perspective view of a golf swing practice device according to an exemplary embodiment of the present invention.
Figure 2:
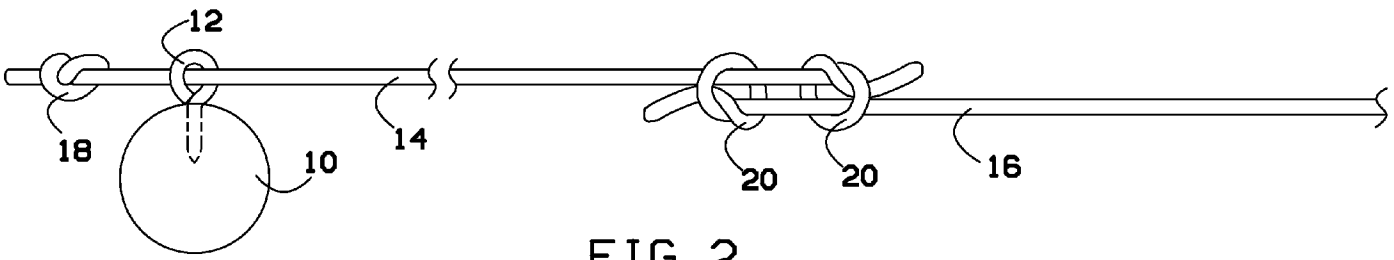
FIG. 2 is a partial side view of the golf swing practice device of FIG. 1, showing a partially secured knot holding two different cord materials.
Figure 3:
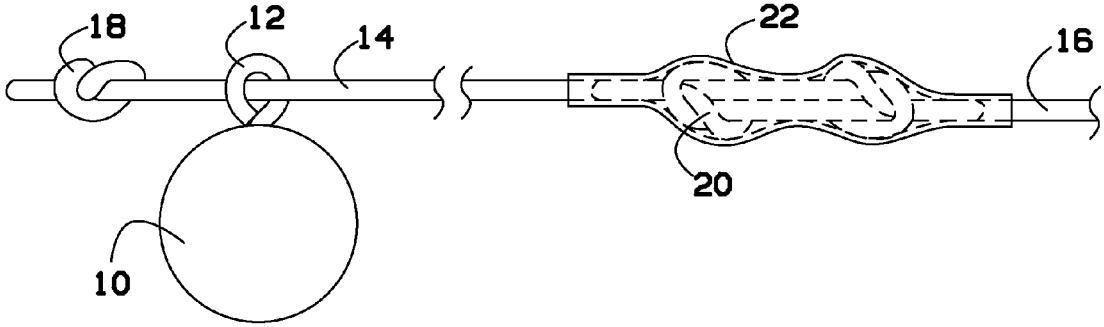
FIG. 3 is a partial side view of the golf swing practice device of FIG. 1, showing the knot secured and sealed.
Figure 4:
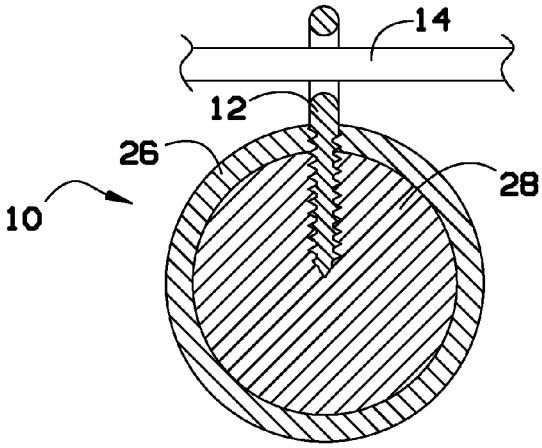
FIG. 4 is a cross-sectional view of a golf ball used with the golf swing practice device of FIG. 1.

Referring now to FIGS. 1 through 4, a golf swing practice device includes a golf ball 10 attached to a more elastic cord 14 which is attached to a less elastic cord 16. The less elastic cord 16 can be attached to a ground securement, such as a weight 24. The ground securement could be some other structure, such as a twist in ground hook, for example.

In some embodiments, the more elastic cord 14 can be a bungee cord, such as a ⅛ inch shock cord with a polypropylene cover. The less elastic cord 16 can be a nylon cord, such as a ⅛ inch 550 parachute cord. Of course, other cords may be used within the scope of the present invention, provided that the cords are of different elasticity.

The less elastic cord 16 can be connected to the more elastic cord 14 by various methods. For example, a fisherman's knot 20 can be used to join the cords 14, 16 together. Other knots or bends can be used to join the cords 14, 16 together. The knot 20 can be covered with a shrink wrap tube 22 to protect the knot 20.

The golf ball 10 can be attached to the more elastic cord 14 with an eyebolt 12. The eyebolt 12 can, for example, screwed into the golf ball 10. The eyebolt 12 can be lightweight to provide the feel of a real ball without weighting down the ball and detracting from its realistic feel. A knot, such as an overhand knot 18, can be tied into the end of the less elastic cord 14 and the cord 14 can be threaded through the eyebolt 12. The knot 18 can prevent the golf ball 10 from sliding off the cord 14.

The golf ball 10 can be made in a two piece solid core ball having an outer cover 26, such as a Surlyn cover, and a solid core 28. The eyebolt 12 can screw into the solid core 28 to provide a secure connection therebetween.

The more elastic cord 14 (bungee cord) can be from about 6 to about 15 feet long, typically about 11 feet long. The less elastic cord 16 (nylon cord) can be from about 5 to about 15 feet long, typically about 9 feet long. The weight 24 can be, for example, a five pound weight.

To use the golf swing practice device, the user can place the weight 24 about 15 feet in front of the place they wish to place the golf ball 10 to practice their swing. The eyebolt 12 can be positioned so that it faces the direction of the shot. The rope (cords 14, 16) can be slightly curved to stay out of the path of the swing to avoid scooping the rope with the club head. When the ball 10 is struck, it flies over the weight to show a maximum flight path of about 20 yards.

When the ball reaches its apex, potential energy is built up in the bungee cord. When it slings back towards the golfer, this energy is absorbed by the inelastic parachute (nylon) cord, causing it to drop approximately half way back. The bungee cord also plays a role to relieve stress on the eyebolt 12. A plain rope would yank at the connector, causing it to slightly loosen with each shot and be more prone to failure.

It should be understood, of course, that the foregoing relates to exemplary embodiments of the invention and that modifications may be made without departing from the spirit and scope of the invention as set forth in the following claims.

What is claimed is:

1. A golf swing practice device comprising:

a golf ball;

an eyebolt disposed directly on an exterior surface of the golf ball;

a first cord having a first end passing through the eyebolt such that the golf ball can move along at least a portion of the first cord, the first cord having a knot formed therein to prevent the golf ball from coming off the first cord, the first cord having a first elasticity;

a second cord attached to a second, opposite end of the first cord, the second cord having a second elasticity, wherein the second elasticity is less than the first elasticity; and a securement attached to the less elastic cord.

2. The golf swing practice device of claim 1, wherein the first cord is a bungee cord.

3. The golf swing practice device of claim 2, wherein the second cord is a parachute cord.

4. The golf swing practice device of claim 1, wherein the securement is a weight.

5. The golf swing practice device of claim 1, wherein the golf ball is a two-piece ball having an outer cover and a solid core.

6. The golf swing practice device of claim 1, wherein the second cord is secured to the second cord with a knot.

7. The golf swing practice device of claim 6, wherein the knot is protected with shrink wrap tube.

8. A golf swing practice device comprising:

a golf ball;

an eyebolt disposed directly on an exterior surface of the golf ball;

a bungee cord having a first end passing through the eyebolt such that the golf ball can move along at least a portion of the bungee cord, the bungee cord having a knot formed therein to prevent the golf ball from coming off the bungee cord, the first cord having a first elasticity;

a parachute cord attached to a second, opposite end of the bungee cord, the parachute cord having a second elasticity, wherein the second elasticity is less than the first elasticity;

a weight attached to the parachute cord; and an eyebolt attached to the golf ball, the bungee cord disposed through the eyebolt.

9. The golf swing practice device of claim 8, wherein the golf ball is a two-piece ball having an outer cover and a solid core.

10. The golf swing practice device of claim 8, wherein the parachute cord is secured to the bungee cord with a knot and the knot is protected with shrink wrap tube.

* * * * *